US007214000B2

(12) United States Patent
Marsh et al.

(10) Patent No.: US 7,214,000 B2
(45) Date of Patent: May 8, 2007

(54) ON-GRADE BARRIER AND METHOD OF ITS USE

(75) Inventors: Charles P. Marsh, Urbana, IL (US); Julie L. Webster, Peoria, IL (US); Gordon L. Cohen, Champaign, IL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 62 days.

(21) Appl. No.: 10/979,852

(22) Filed: Nov. 3, 2004

(65) Prior Publication Data

US 2006/0093431 A1 May 4, 2006

(51) Int. Cl.
*E01F 13/00* (2006.01)
*E01F 13/12* (2006.01)

(52) U.S. Cl. ..... 404/6; 404/9; 404/11

(58) Field of Classification Search ..... 404/6, 404/9–11; 256/13.1

See application file for complete search history.

(56) References Cited

U.S. PATENT DOCUMENTS 4,554,695 A * 11/1985 Rowland ..... 14/69.5
4,576,509 A * 3/1986 Beaty, Sr. ..... 404/6
4,624,600 A * 11/1986 Wagner et al. ..... 404/6
4,647,246 A * 3/1987 Brink et al. ..... 404/6
4,705,426 A 11/1987 Perea
4,775,261 A * 10/1988 Fladung ..... 404/6
4,826,349 A 5/1989 Nasatka
5,228,237 A 7/1993 Nasatka
5,975,791 A * 11/1999 McCulloch ..... 404/6
6,224,291 B1 5/2001 Mateychuk
6,227,523 B1 5/2001 Haberlen
2003/0016996 A1 1/2003 Gelfand et al.
2005/0201827 A1* 9/2005 Rastegar et al. ..... 404/6

* cited by examiner

*Primary Examiner*—Raymond Addie
(74) *Attorney, Agent, or Firm*—Earl H. Baugher, Jr.

(57) ABSTRACT

An unobtrusive on-grade barrier. One embodiment comprises a concrete-lined trench over which a biased hinged plate is affixed to an end wall of the trench. The biased hinge holds the free end of the plate against a tab affixed to the other end wall, assuring the plate does not rise above grade. The plate is supported for vehicle passage by a sliding mechanism energized by an actuator controlled by a controller that may be automated or operated by security personnel. The barrier may be configured so that vehicles may approach from either end. Upon authorizing access to the driver, the vehicle is permitted to pass over the supported plate. If the driver is not authorized access, the support is slid out of the way and any vehicle attempting to pass slides into the trench. Embodiments may include means for clearing the trench of a trapped vehicle.

5 Claims, 7 Drawing Sheets

ON-GRADE BARRIER AND METHOD OF ITS USE

STATEMENT OF GOVERNMENT INTEREST

Under paragraph 1(a) of Executive Order 10096, the conditions under which this invention was made entitle the Government of the United States, as represented by the Secretary of the Army, to the entire right, title and interest therein of any patent granted thereon by the United States. This patent and related ones are available for licensing. Contact Bea Shahin at 217 373-7234 or Phillip Stewart at 601 634-4113.

BACKGROUND

Unwanted ingress by vehicles into a secure location continues to be a problem. Car and truck bombs, or other weapons delivered in a similar fashion, represent a major concern. Conventional countermeasures include interspersing large, heavy obstacles to impede vehicle access. This gives rise to an obvious defensive "under siege" appearance. An effective means is needed to control vehicular access without presenting such a cumbersome and high profile appearance.

DETAILED DESCRIPTION

Figure 1:
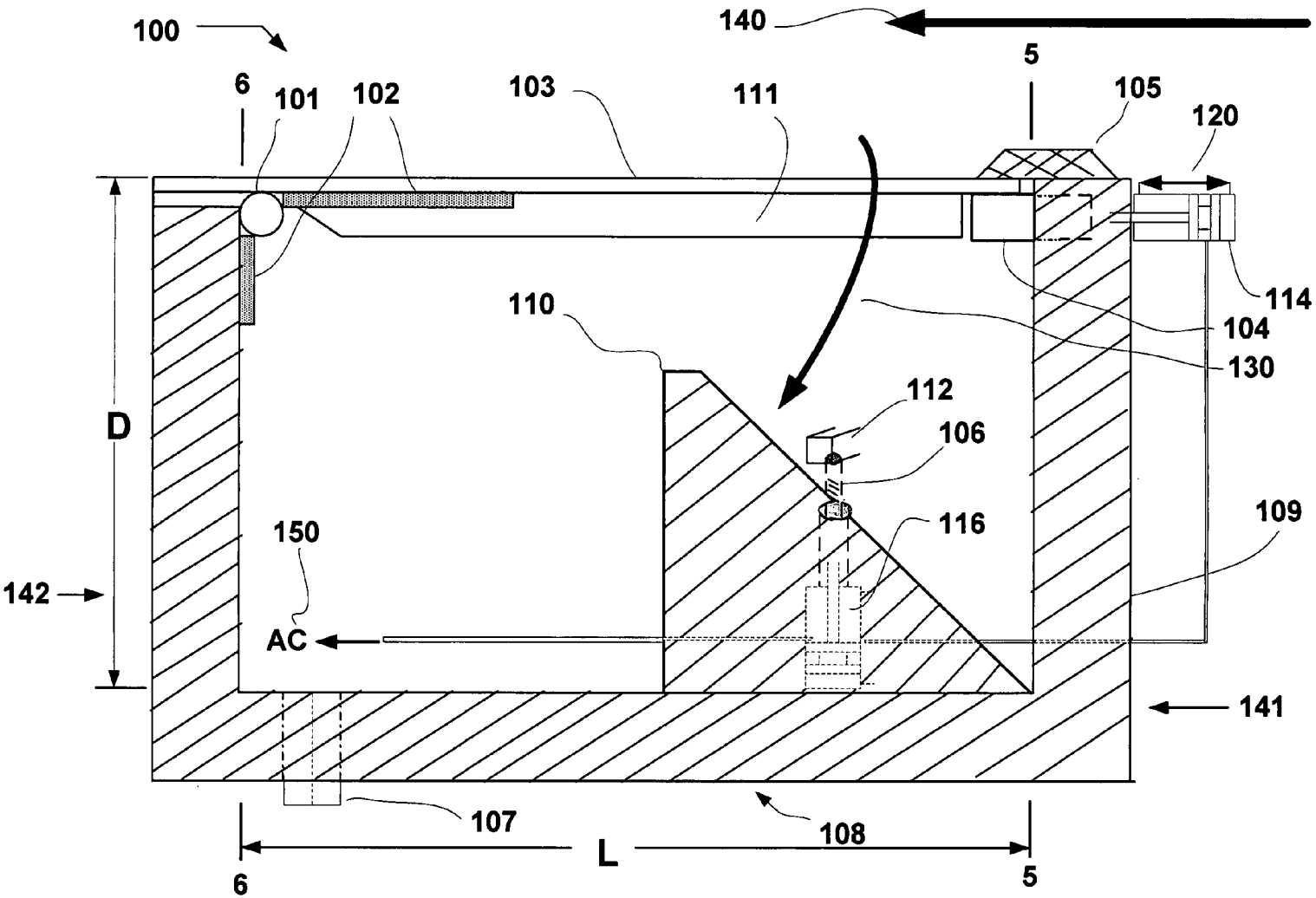
FIG. 1 is a side view of an embodiment of the present invention with the near wall removed.

In select embodiments of the present invention, an unobtrusive barrier is provided for preventing access by unauthorized vehicular traffic. At least a portion of the barrier is located below grade. In select embodiments of the present invention, the barrier comprises a trench; means for controlling the barrier located near the trench; means for impeding vehicular access communicating with the means for controlling, at least part of the means for impeding located in the trench; and means for clearing impeded access communicating with the means for controlling. In select embodiments of the present invention, at least part of the means for clearing is located in the trench.

In select embodiments of the present invention, the trench is at least partially lined with reinforced concrete. In other embodiments a structure may be fabricated off-site from a suitable material, such as steel or the like, and "dropped in" the trench.

In select embodiments of the present invention, the means for controlling comprises one or more controllers; one or more first actuators in operable communication with both the controller and at least the means for impeding; and one or more second actuators in operable communication with the controller and at least the means for clearing.

In select embodiments of the present invention, the means for controlling comprises one or more remote controls capable of communication with at least the controller.

In select embodiments of the present invention, the means for controlling comprises one or more indicators communicating with the controller, at least one of which is visible by a vehicle operator.

In select embodiments of the present invention, the means for controlling further comprises one or more communications links to other resources.

In select embodiments of the present invention, the means for controlling further comprises one or more redundant paths for controlling various elements of the barrier.

In select embodiments of the present invention, the means for impeding comprises one or more hinged plates attached to the top of the trench, the plates having a hinged end opposing a free end. The free end is free to move within the trench unless otherwise constrained.

In select embodiments of the present invention, the means for impeding comprises one or more springs attached to the hinged plates and one or more retaining tabs at one end of the top of the trench, the tab provided to retain the free end of the hinged plate in a position approximately on-grade.

In select embodiments of the present invention, the means for impeding comprises one or more mechanisms, such as sliding mechanisms, connected to the first actuators. These mechanisms are capable of selectively supporting the hinged plates at their free end.

In select embodiments of the present invention, the means for impeding comprises one or more retaining structures, the structures capable of selectively supporting the hinged plate below grade.

In select embodiments of the present invention, the means for clearing comprises one or more lifting mechanisms connected to the second actuators and one or more cross bars connected to the lifting mechanisms to aid in lifting the hinged plate from below grade to an approximately on-grade position. In select embodiments of the present invention, the lifting mechanisms may be selected from the group consisting of: screw jacks, hydraulic jacks, scissors jacks, combinations thereof, and the like.

In select embodiments of the present invention, one or more sources of power are connected to at least the means for controlling. In select embodiments of the present invention, the sources of power are also connected to the means for clearing.

In select embodiments of the present invention, there are provided means for manually overriding at least the means for controlling.

Also provided in embodiments of the present invention is a method for controlling access of vehicular traffic using a non-obtrusive on-grade system at least part of which is located below grade at an access or entry point in a roadway. The method comprises providing a trench at the access point; providing means for controlling the barrier near the trench; providing means for impeding vehicular access communicating with the means for controlling, at least part of the means for impeding located in the trench; and providing means for clearing impeded access communicating with the means for controlling, at least part of the means for clearing located in the trench.

In select embodiments of the present invention, the method provides for lining the trench at least partially with reinforced concrete.

In select embodiments of the present invention, the method provides one or more power sources communicating with the means for controlling.

In select embodiments of the present invention, the method provides one or more redundant paths for controlling the barrier.

In select embodiments of the present invention, the method provides for manually overriding the means for controlling.

In select embodiments of the present invention, the method provides for remotely controlling at least the means for controlling.

In select embodiments of the present invention, the method provides for one or more indicators of the status of the barrier to be provided to the controller with at least one of the indicators visible to the vehicle operator of the vehicle being considered for access.

In select embodiments of the present invention, a method for controlling access by vehicular traffic comprises providing any of the variations of an on-grade barrier with a hinged plate and supporting mechanism as described above; ascertaining proper authorization of a vehicle operator desiring access; actuating the supporting mechanism for the plates; and authorizing the vehicle operator to proceed.

In select embodiments of the present invention, a method for controlling access by vehicular traffic comprises providing a barrier with a hinged plate and supporting mechanism as described above; ascertaining improper authorization of a vehicle's operator; de-actuating the supporting mechanism; and refusing authorization to proceed.

In select embodiments of the present invention, an unobtrusive barrier for controlling access of vehicles comprises a trench having end and side walls, the end walls described by the width and depth of the trench; one or more plates affixed by at least one biased hinge to the top of the end wall opposite the side of approach of vehicles; one or more tabs affixed to the top of the end wall on the approach side, such that the biased hinge holds the free end of the plate against the tab assuring the plate does not rise above grade; slidable support for the free end of the plate, such that a vehicle is permitted to pass by sliding the slidable support under the plate's free end; one or more actuators for energizing the slidable support; and one or more controllers communicating with the actuators, such that if a vehicle attempts to pass without authorization, the support is disabled and at least a portion of the vehicle slides into the trench.

In select embodiments of the present invention, the angle of approach to said trench may be varied so that a vehicle may approach from any angle with respect to the location of the biased hinge.

In select embodiments of the present invention, the controller may be at least partially automated.

Refer to FIG. 1. An embodiment of the present invention provides an on-grade barrier 100 of internal length, L, internal depth, D, and internal width, W (FIGS. 5 and 6), consisting of one or more plates 103, such as thick aluminum "diamond plate," supported over a trench 108 that may be lined with reinforced concrete 109. The plates 103 are equipped with hinges 102 that permit vertical movement of the plates 103 about the hinges 102. In select embodiments of the present invention, the hinges 102 may be biased with one or more springs 101. In use, given an appropriate scenario, the plates 103 fall away into the trench 108 if a vehicle approaching in the direction indicated by the arrow 140 is meant to be immobilized. In practice the barrier 100 may be sufficiently large to deter vehicles normally traversing roadways. For example, L×W×D may be approximately 5 m×3 m×2 m.

In select embodiments of the present invention, one or more springs 101 are attached to the plates 103 with sufficient capacity to hold an unloaded plate 103 against a catch lip or tab 105. In select embodiments of the present invention, the springs 101 provide sufficient resistance to support the weight of an adult on the plates 103 but not that of a vehicle. In select embodiments of the present invention, on the side 141 opposite from the spring 101 is a latch mechanism 104 with latch actuator 114 that may be toggled between modes of support and release as indicated by arrow 120 (to viewer's left, support; to viewer's right, release).

To allow vehicle passage over the barrier 100 the support mode is chosen. For operation as a barrier, the latch mechanism 104 is activated by the latch actuator 114 to release and, upon sufficient weight impressed on the plates 103, they fall as shown with the curved arrow 130. Thus, any vehicle that attempts to proceed while the barrier 100 is in this mode causes the plates 103 to swing down in the direction of the curved arrow 130. The plates 103 are stopped on a robust structure 110, constructed of material such as reinforced concrete and the like, configured to both support the plates 130 and vehicle and to protect a lift bar 112 and its mechanism 106. With no on-grade support the front of the vehicle drops into the trench 108, stopping its forward progress. In select embodiments of the present invention, the sharp drop-off coupled with the depth, D, of the trench 108, prevents the vehicle from backing out of the trench 108 using its own power, so that the lift actuator 116 and lift mechanism 106 must be employed with a cross bar 112 to lift the vehicle. In select embodiments of the present invention, one or more built-in hydraulic or screw-actuated lifts 106 are provided with one or more cross bars 112 to quickly clear the barrier 100 after use, thus expediting traffic flow. The lift mechanism 106 may be actuated by a powered actuator 116, such as a reversible AC motor. In addition, if the lift mechanism 106 is set in the up or extended position it adds an additional safety factor for support of the plates 103. In select embodiments of the present invention, AC power 150 is provided to the latch and lift actuators 114, 116.

For the default position in a low threat environment, the plates 103 remain supported. The edge of the plates 103 closest to the hinges 102 may be machined at an angle to allow for the plate 103 to clear as shown in FIG. 1. For high threat environments the default is to release the mechanism 104, so that only each time access is granted the support is actuated, i.e., a single vehicle passes after access is granted and the support mechanism is de-activated thereafter until the next vehicle is granted access. Alternatively, routing traffic through lanes incorporating such an on-grade barrier 100 may be reserved for a high threat scenario wherein other access points are blocked.

In select embodiments of the present invention, a drain 107, such as a French or rubble drain, is provided in the trench 108. Further, to prevent build up due to heavy rain, runoff, etc., one or more sump pumps (not shown separately) and one or more check valves (not shown separately) may be employed.

Figure 2:
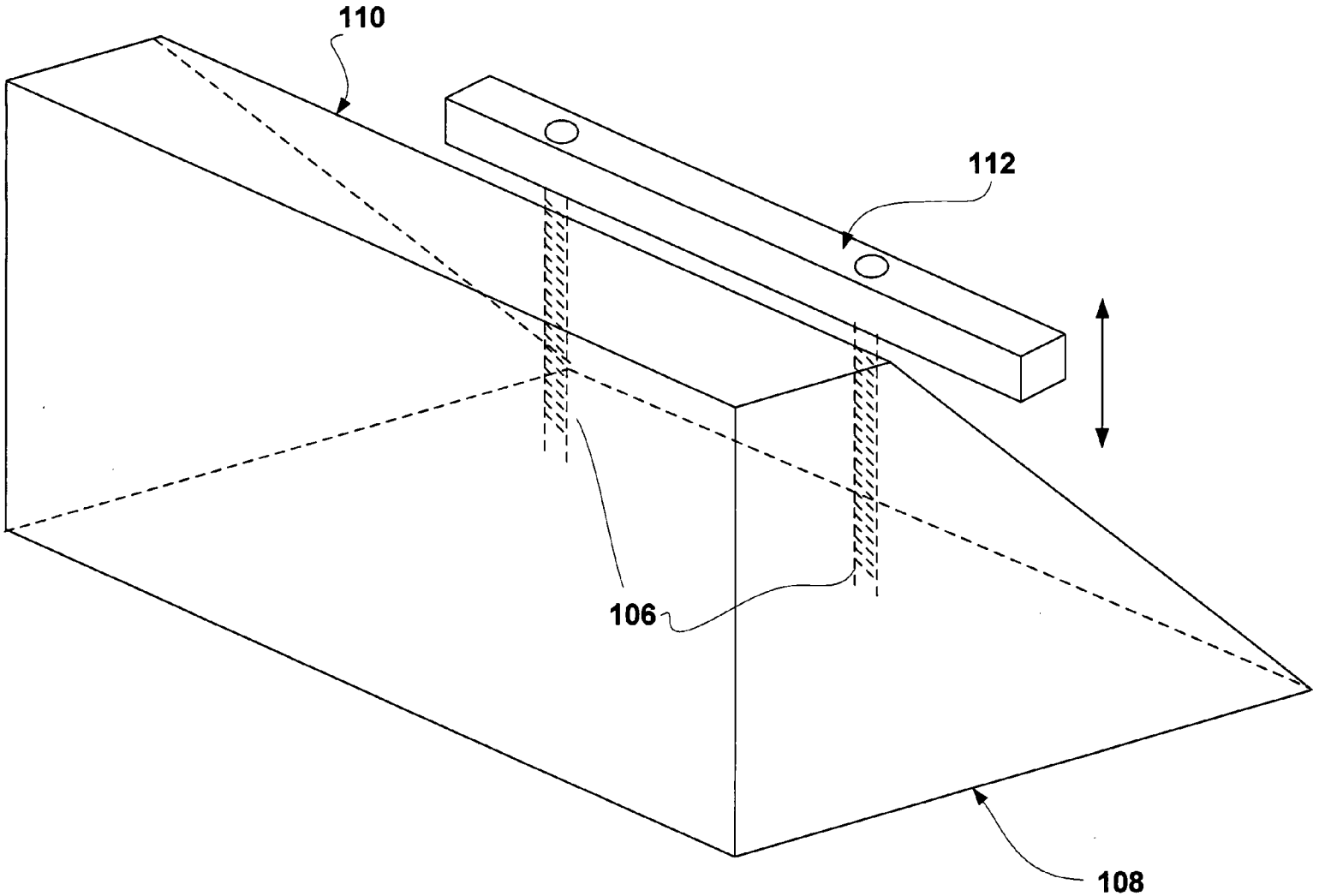
FIG. 2 is an isometric view of an internal section of an embodiment of the present invention.
Figure 4:
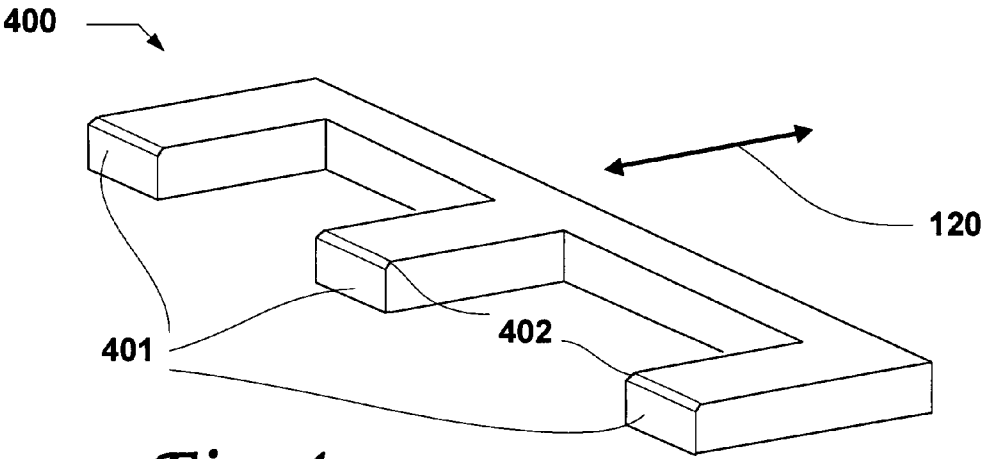
FIG. 4 is an isometric view of a portion of an actuating mechanism that may be used with an embodiment of the present invention.

Refer to FIG. 2 depicting a robust structure 110 configured to both "catch" any unsupported vehicle and to protect the lift mechanisms 106 and cross bars 112. In select embodiments of the present invention, the cross bar 112 itself may be used for supporting the plates 103 at the end that drops. In a low-threat environment, the cross bars 112 may be raised in place as the default position. In a moderate or high-threat environment the cross bars 112 are lowered to permit ready operation of the "swing-down" feature of the barrier 100 if need be. The cross bars 112 may be any of a number of suitable configurations, such as a solid bar, a box beam, a double-T configuration 400 as shown in FIG. 4, and the like. The cross bars 112 may be moved into a support position by either a hydraulic or mechanical means such as the screw jacks 106 shown in FIG. 2 for clarity. For the release position to prevent damage to the cross bars 112 and lift mechanism 106, the cross bars 112 are positioned below the top of the structure 110, i.e., a distance sufficient to allow the plates 103 to swing open and hit the top of the structure 110. The areas of the barrier 100 that are subject to friction or abrasive wear may be surfaced with a replaceable material such as rubber, resilient synthetic materials, and the like.

Figure 3:
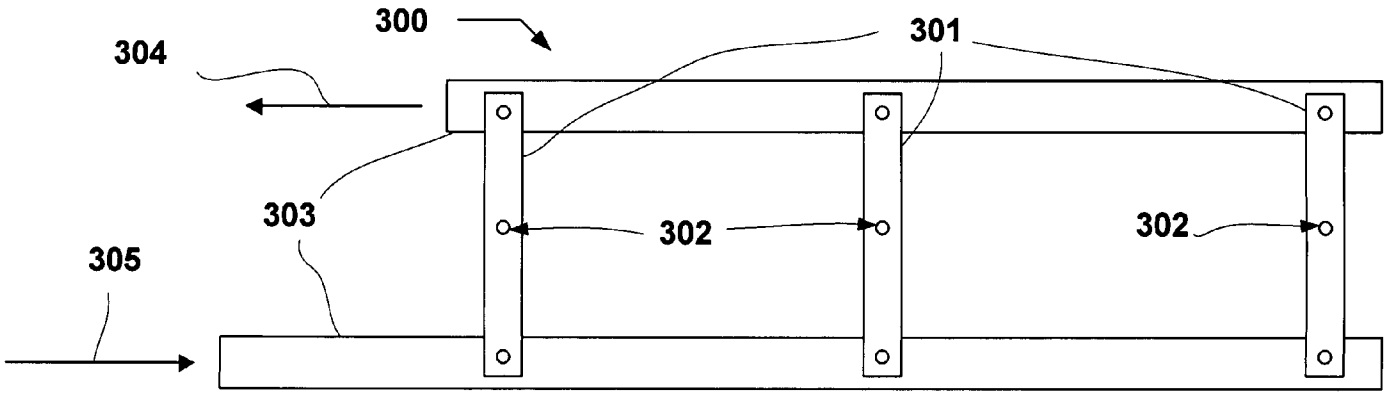
FIG. 3 is a side view of a portion of an actuating mechanism that may be used with an embodiment of the present invention.

Refer to FIGS. 3 and 4. In select embodiments of the present invention, hinged mechanical tie rods 301 are connected to parallel sides 303 of an actuator 300. The tie rods 301 pivot on central points 302 to diagonally slide a support plate, such as shown in FIG. 4 as cantilevered T-support 400, into or out of position as indicated by arrows 304, 305. The hinged support plate 300 swings up when the cantilevered supports 400 are pushed out and support the "bridging" plates 103. The base 401 of the "T's" may be square or rectangular in cross section. In select embodiments of the present invention, the leading top edge 402 of the bases 401 is chamfered (as shown in FIG. 4) and may have a friction reducing wear surface, such as nylon, TEFLON®, and the like. Actuation of the moving supports 400 may be via any of a number of means, such as magnetic attraction, hydraulics, electric motor driven screw drive, and the like. In select embodiments of the present invention, an emergency backup may be provided as a mechanical linkage (not shown separately) using a rotating wheel (not shown separately). In these embodiments, in the event of a power outage the barrier 100 remains operational.

Figure 5:
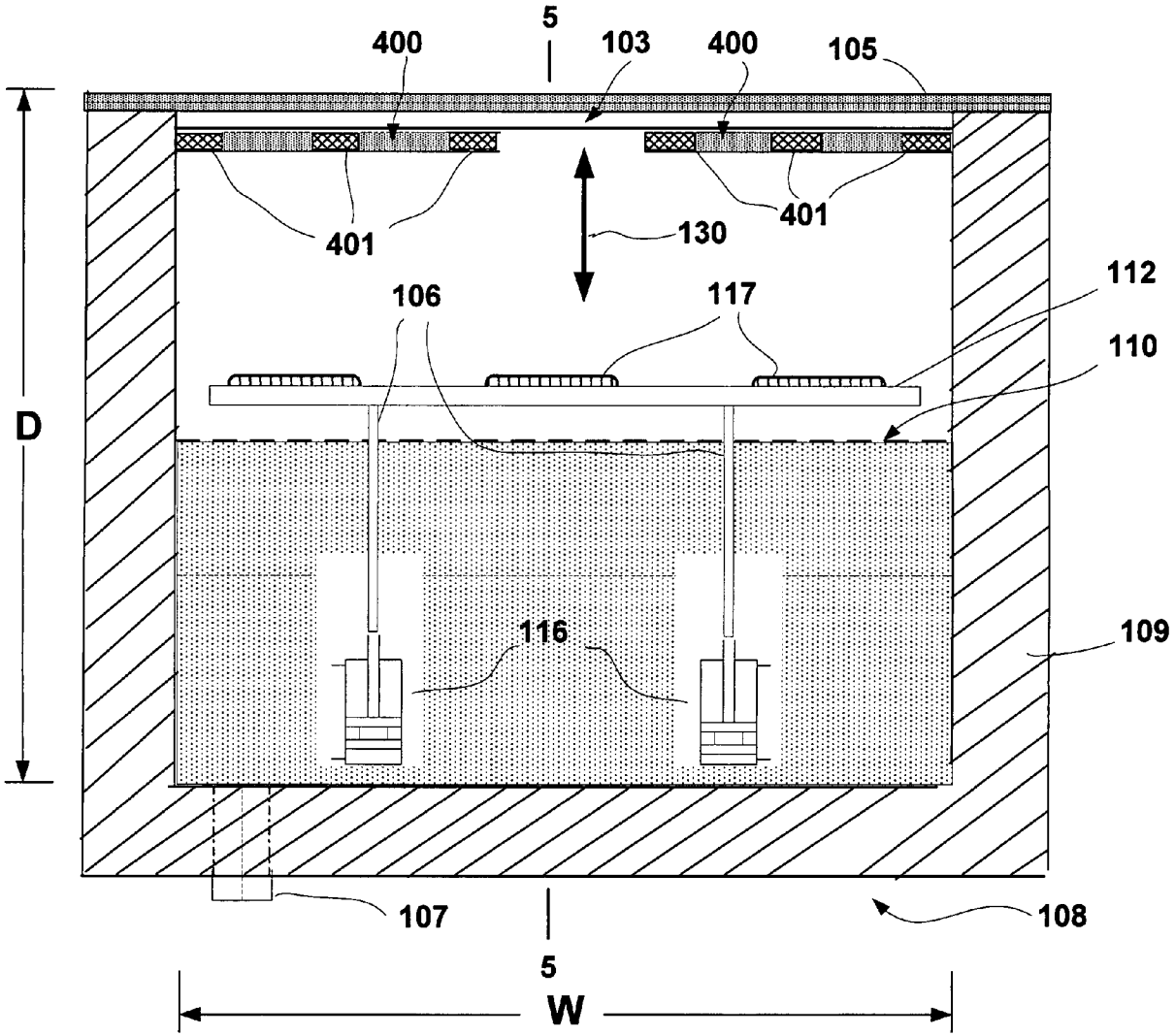
FIG. 5 is a cross section through 5—5 of FIG. 1, presenting an end view of a first end of an embodiment of the present invention.

Refer to FIG. 5, an end view of the barrier 100 through 5—5 of FIG. 1. This is the end at which a vehicle may approach the barrier 100 to cross the plate 103. The lift mechanism 106, the lifting actuator 116, and the cross bar 112 are shown in front of the structure 110. In FIG. 5, the cross bar 112 is fitted with optional "bearings" 117, such as roller or needle bearings, and the like, to reduce friction against the plates 103 since the plates 103 drop in an arc and are being raised via a linear motion. As an option, a curved lifting mechanism (not shown separately) without any "bearings" may be used to contact the end of the plates 103 and raise them in an arc that is the reverse of the arc that dropped the plates 103. Also shown is the latch mechanism 400 of FIG. 4 with the "T" bases 401, the plate 103 and the upper lip or tab 105. The cross bar 112 is shown in the "partially up" position, i.e., it is not protected by the structure 110. This is the position it would pass through if it were lifting a vehicle from the trench 108.

Figure 6:
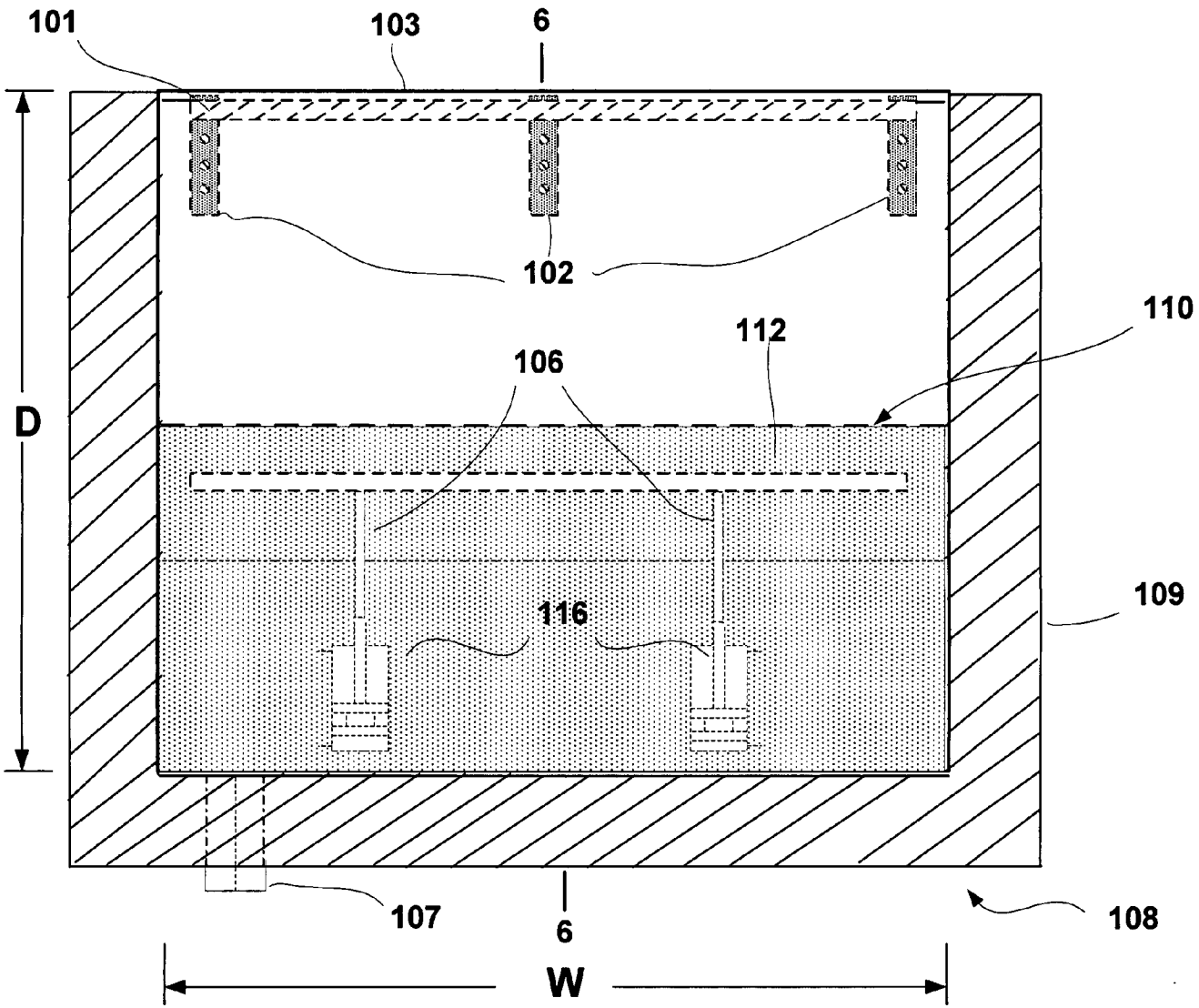
FIG. 6 is a cross section through 6—6 of FIG. 1, presenting an end view of an end of an embodiment of the present invention opposite the end of FIG. 5.

Refer to FIG. 6, an end view of the barrier 100 through 6—6 of FIG. 1. This is the end opposite that at which a vehicle approaches the barrier 100 to cross the plate 103. The lift mechanism 106, the means for lifting 116, and the cross bar 112 are shown behind the structure 110. Also shown are the spring 101 and strap hinges 102. The cross bar 112 is shown in the "downs" position, i.e., it is protected by the structure 110. This is the position it would be in if it were positioned ready for a vehicle to enter the trench 108.

Figure 7:
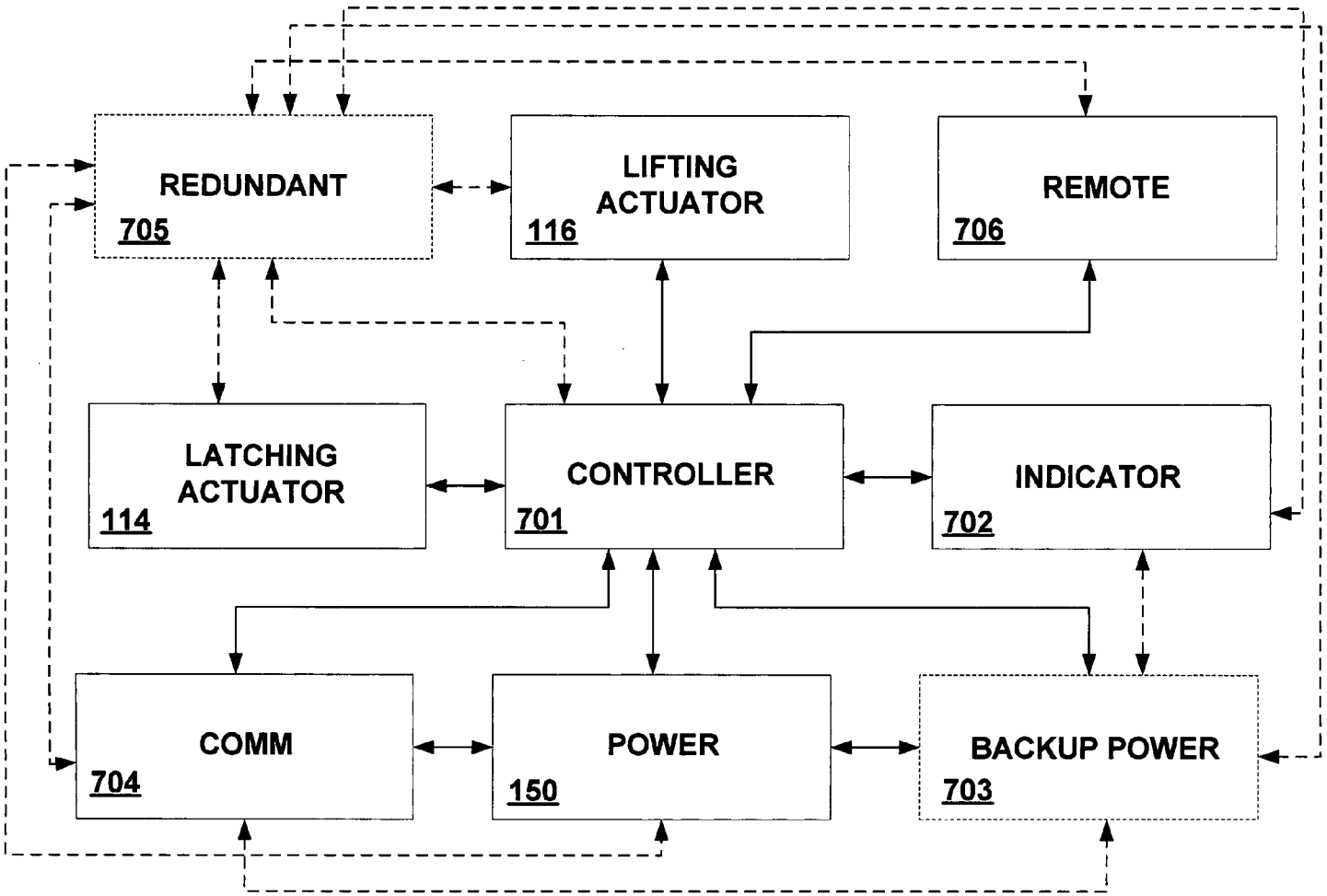
FIG. 7 is a block diagram of a control system that may be used with an embodiment of the present invention.

Refer to FIG. 7, a block diagram describing the interrelationship of elements of the barrier 100 as provided in select embodiments of the present invention. In select embodiments of the present invention, a controller 701 is used to actuate the latching 114 and lifting 116 actuators. Feedback is provided from each of the actuators 114, 116 to the controller 701 to insure the required action has been carried out. The controller 701 receives power from an AC power source 150 and also may operate from a backup source 703, such as a generator, battery, and the like, should the power source 150 fail. Should there be a power failure, power from the backup 703 is routed through the controller 701 to the other elements. The power source 150 also energizes a communications link 704 that automatically sends system status to the controller. The communications link 704 may also be used by the controller to alert remote operations, such as a security squadron, headquarters, and the like. To insure personnel are aware of the status of the barrier 100, an indicator 702 is provided to alert both system operators at the controller 701 and vehicle operators. The indicator 702 may be as simple as a two color lighting system that is green for pass and red for wait. The indicator 702 is also attached to a backup power source 703 since it must be available even in a power outage. In select embodiments of the present invention, the controller 701 may be accessed remotely via one or more remote controls 706. In select embodiments of the present invention, because of the importance of assuring security, the system may be provided with a redundant capability 705 that may include one or more of the other functions including the controller 701, but as a minimum a link to both actuators 114, 116 and the controller 701.

Figure 8:
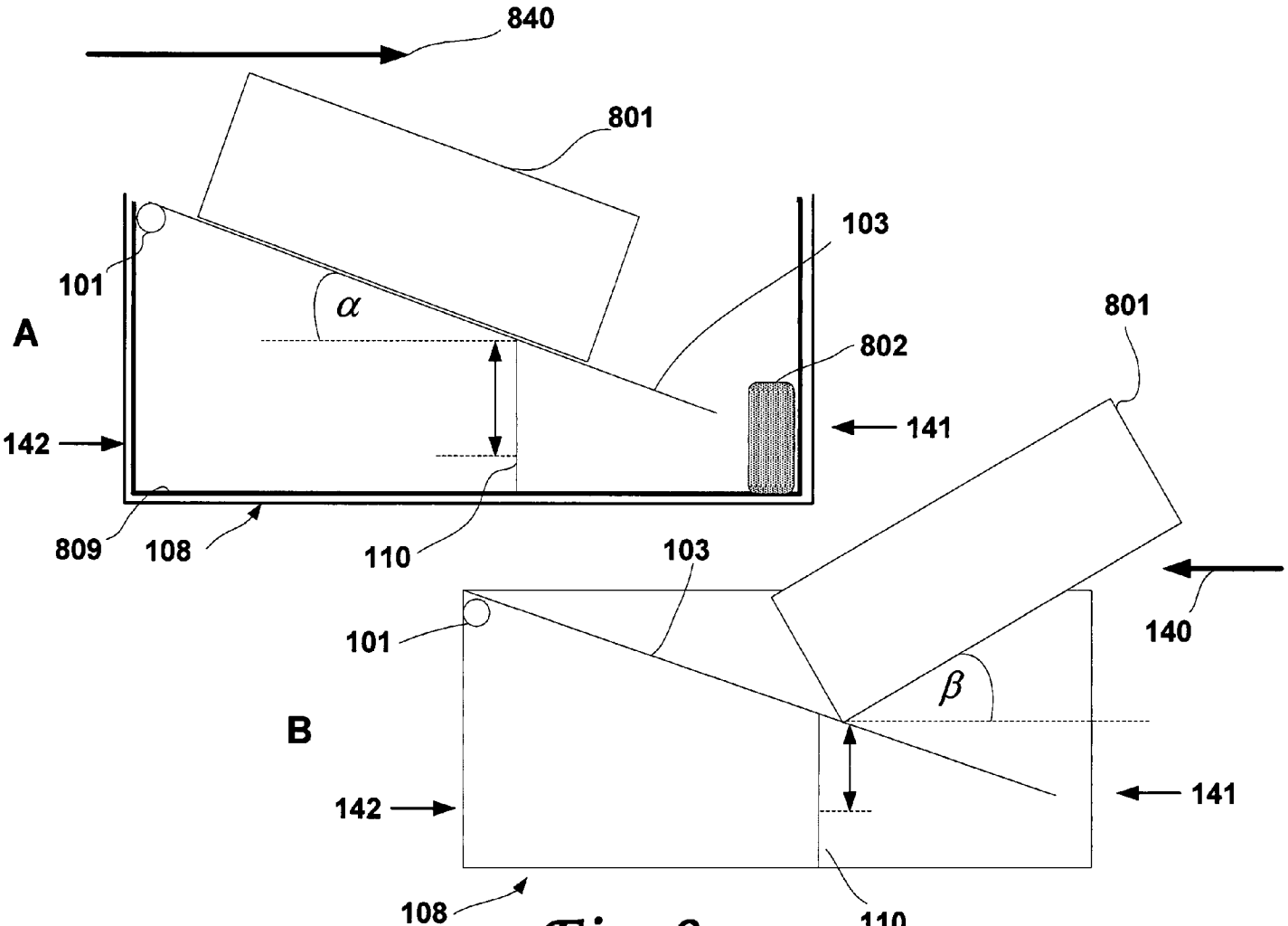
FIG. 8 is a line drawing of two of the many ways that an embodiment of the present invention may be used.

Refer to FIG. 8. In A, the vehicle 801 has approached the barrier in a direction indicated by the arrow 840. This is the opposite setup from FIG. 1 and B of FIG. 8. Note that FIG. 8 in A depicts a "drop-in" structure 809 that maybe constructed of any suitable material, such as steel plate. If the barrier is setup for a vehicle 801 to first approach over the hinged side 142 where the support spring 101 is located, then the plate 103 serves as a ramp upon which the vehicle 801 is "guided" into the trench 108. The angle, $\alpha$, at which the vehicle 801 is guided into the trench 108 may be set to meet a user's requirements by varying the height of the structure 110. For example, if "self-recovery" of the vehicle 801 is deemed appropriate, $\alpha$ may be set much less than 45° to permit the vehicle 801 to back out of the trench 108 under its own power. However, if $\alpha$ is set to 45° or greater, it may not be possible for the vehicle 801 to back out under its own power, effectively trapping the vehicle 801. In select embodiments of the present invention, the structure 110 may be adjusted in height to change the angle, $\alpha$. In select embodiments of the present invention, a bumper 802 may be provided to protect both the vehicle 801 and the end wall of the trench 108. In B, the vehicle 801 has approached the side 141 opposite the hinge in the direction of the arrow 140, i.e., in the same direction as shown in FIG. 1. As shown in B, the vehicle is not "guided" down the plate 103 as a ramp but rather drops until the plate is stopped on top of the structure 110. The vehicle is then trapped in the trench 108 at the angle, $\beta$, to the horizontal. $\beta$ is shown as greater than $\alpha$ to illustrate another option for use of an embodiment of the present invention. $\beta$ may be chosen to be severe enough to lift the rear wheels of the vehicle 801 off the payment, effectively prohibiting self-recovery of a rear-drive vehicle. This assumes the vehicle 801 proceeds far enough along the dropping plate 103 to preclude reversing direction before dropping to the structure 110. Here also, the height of the structure 110 may be adjusted to meet a user's requirements. For example, the height of the structure 110 may be adjusted to "trap" large trucks and busses as well as passenger vehicles.

Accordingly, all such modifications are intended to be included within the scope of this invention as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

The abstract is provided to comply with the rules requiring an abstract, which will allow a searcher to quickly ascertain the subject matter of the technical disclosure of any patent issued from this disclosure. 37 CFR §1.72(b). Any advantages and benefits described may not apply to all embodiments of the invention.

We claim:

1. An on-grade unobtrusive barrier for controlling access of vehicles by guiding below grade at least part of an unauthorized vehicle attempting to enter while providing safe on-grade passage for at least one adult pedestrian even when set to deny passage of said vehicles, comprising:

at least one controller, wherein said controller automates operation of said barrier;

a trench described by a length, width and depth and having end and side walls, said end walls described by said width and said depth;

at least one unobtrusive plate affixed by at least one biased hinge to the top of a first said end wall, said hinge biased by at least one spring;

at least one tab affixed to the top of a second said end wall that is opposite said first end wall;

wherein said biased hinge holds the free end of said plate against the bottom of said tab thus assuring said plate does not rise above grade;

slidable support for said free end of said plate, wherein said vehicle is permitted to pass by sliding said slidable support under said free end;

at least one first actuator in operable communication with said controller and said slidable support, wherein the operation of said actuator is automated via operation of said controller, and wherein should said vehicle attempt to pass without authorization, said support is disabled and at least a portion of said vehicle slides into said trench; and means for lifting a vehicle from said trench, said means for lifting in operable communication with said controller.

2. The barrier of claim 1 in which said trench is at least partially lined with reinforced concrete.

3. The barrier of claim 1 in which said trench is at least partially lined with a pre-fabricated structure.

4. The barrier of claim 1 in which said means for lifting comprises:

at least one lilting mechanism in operable communication with at least a second actuator that is in operable communication with said controller; and at least one cross bar in operable communication with said lifting mechanism, said cross bar configured so as to at least reduce friction between said cross bar and said plate on contact of said cross bar with said plate upon activation of said lifting mechanism.

5. The barrier of claim 4 in which said lifting mechanism is selected from the group consisting essentially of: screw jacks, hydraulic jacks, scissors jacks, and combinations thereof.

* * * * *